US008959858B1

(12) United States Patent
Francisco

(10) Patent No.: US 8,959,858 B1
(45) Date of Patent: Feb. 24, 2015

(54) DECK DRAIN AND ASSOCIATED METHODS

(71) Applicant: James Francisco, West Melbourne, FL (US)

(72) Inventor: James Francisco, West Melbourne, FL (US)

( * ) Notice: Subject to any disclaimer, the term of this patent is extended or adjusted under 35 U.S.C. 154(b) by 0 days.

(21) Appl. No.: 13/963,713

(22) Filed: Aug. 9, 2013

(51) Int. Cl.
*E04F 17/00* (2006.01)
*E04B 1/70* (2006.01)

(52) U.S. Cl.
CPC ..... *E04F 17/00* (2013.01)
USPC ..... 52/302.3

(58) Field of Classification Search
USPC ..... 52/302.3, 169.5, 302.1; 404/2, 4
See application file for complete search history.

(56) References Cited

U.S. PATENT DOCUMENTS

| | | | | |
|---|---|---|---|---|
| 4,235,008 | A * | 11/1980 | Meredith | 29/428 |
| 4,490,067 | A * | 12/1984 | Dahowski | 404/4 |
| 4,815,888 | A * | 3/1989 | Stegmeier | 404/4 |
| 4,940,359 | A * | 7/1990 | Van Duyn et al. | 405/118 |
| 5,853,265 | A * | 12/1998 | Gunter | 405/118 |
| 6,129,838 | A | 10/2000 | Millner | |
| 6,230,468 | B1 * | 5/2001 | Klaus | 52/741.11 |
| 6,792,723 | B2 | 9/2004 | Stegmeier, Sr. et al. | |
| 6,802,962 | B1 | 10/2004 | Browne, III et al. | |
| 6,908,256 | B1 * | 6/2005 | Humphries et al. | 404/2 |
| 6,942,419 | B2 | 9/2005 | Knak et al. | |
| D579,531 | S * | 10/2008 | Musser | D23/261 |
| 7,794,176 | B2 * | 9/2010 | Musser | 405/118 |
| 8,239,974 | B2 * | 8/2012 | Erlebach | 4/291 |
| 8,474,068 | B2 * | 7/2013 | Kik et al. | 4/613 |
| 8,505,131 | B2 * | 8/2013 | Doolittle et al. | 4/613 |
| 2012/0110827 | A1 * | 5/2012 | Doolittle et al. | 29/527.1 |

OTHER PUBLICATIONS

"Pool Deck Drain with Removable Tops", Document retrieved using internet archive, WayBackMachine (web.archive.org), from http://www.aquamasters.com/frontierremovabletopdrain.htm, having a publication date of Apr. 2, 2010.

* cited by examiner

*Primary Examiner* — Mark Wendell
*Assistant Examiner* — Keith Minter
(74) *Attorney, Agent, or Firm* — Mark R. Malek; Jeremy S. Howard; Widerman Malek, PL

(57) ABSTRACT

A deck drain system may include a deck drain having an elongate tube which may be defined by a bottom portion and a top portion. The bottom portion may include an arcuate shape. The top portion may be flat and include an opening. A removable top member may engage the opening formed in the top portion of the elongate tube. The removable top member may include a main body portion which includes a plurality of slots. The plurality of slots formed in the removable top member may include a spacing therebetween that is substantially similar to the spacing between the plurality of slots formed in the top portion. The removable top member may be removeably connected to the top portion of the elongate tube so that, when removed, an interior portion of the elongate tube is accessible.

17 Claims, 4 Drawing Sheets

DECK DRAIN AND ASSOCIATED METHODS

FIELD OF THE INVENTION

The present invention relates to field of drainage and, more specifically, to the field of deck drains to be used in connection with pools surfaces.

BACKGROUND OF THE INVENTION

Swimming pools are a common feature for many residential and commercial properties. Since some people do not live near an ocean, river, or other large body of water, a swimming pool allows for recreational fun and aquatic exercises in areas that would not have it by natural means. In other instances, swimming pools provide a more controlled environment for people to enjoy the activity of swimming. Many people also enjoy swimming pools because they can be conveniently accessed.

The immediate area surrounding the pool can become wet as a result of the splashing and/or people entering or leaving the pool. Therefore, the area around the pool must have proper drainage so that the surrounding area can be kept as dry as possible, and to prevent water buildup and/or intrusion into adjacent structures. Rain water can also collect on the immediate area surrounding the pool and it is undesirable for the pool deck to remain wet, or to have standing water on the pool deck. Further, when there may be heavy rains, pools may overflow, causing water to collect on the pool deck.

Most pools include deck drains installed at an offset distance between a perimeter of the pool and an adjacent structure to assist in draining the area surrounding the pool so that water does not collect adjacent to the structure and, if too much water is allowed to collect, cause water intrusion into the structure. The deck drain is designed to provide a path of drainage for standing water between the pool and any adjacent structure. The water that is displaced from the pool is allowed to flow back into the pool or into a secondary drainage area via a drainage system that connects to the deck drain.

U.S. Pat. No. 6,792,723 to Stegmeier, Sr. et al. (hereafter referred to as Stegmeier) discloses a deck drain. The deck drain of Stegmeier includes a plurality of slots that drain the water from the platform that surrounds the pool. However, the deck drain disclosed in Stegmeier can be readily clogged, and does not provide access within the drain to facilitate easy cleaning.

Deck drains with a removable top are available from Aquamasters USA http://www.aquamasters.com/frontierremovabetopdrain.htm. The deck drain provided by Aquamasters includes a bottom portion and a top portion. The top portion, referred to as the cap, includes a pair of lips that extend from the bottom of the cap. The lips extend the longitudinal length of the deck drain and fit into the deck drain by snapping into place, matingly engaging the top of the bottom portion of the Aquamasters deck drain. The Aquamasters deck drain does not enable a user to partially remove a top portion or cap of the deck drain. Instead, the Aquamasters deck drain is made to replace an entire drain, and is not suitable for retrofitting an existing drain. Accordingly, installation cost of the Aquamasters deck drain may be high.

A need exists for a deck drain that provides a top portion that is partially removable. This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the foregoing in mind, the present invention is related to a deck drain system that has a removable top member. The deck drain system according to embodiments of the present invention may advantageously allow for simplified cleaning of a deck drain. The deck drain system may also allow for more efficient draining of the pool area. The deck drain system according to embodiments of the present invention also advantageously allows for retrofitting an existing deck drain system to provide simplified cleaning.

These and other objects, features and advantages according to the present invention are provided by a deck drain system including a deck drain having an elongate tube which may be defined by a bottom portion and a top portion. The bottom portion may include an arcuate shape. The top portion may be flat and include an opening. A removable top member may engage the opening formed in the top portion of the elongate tube. The removable top member may include a main body portion which includes a plurality of slots. The main body portion may include a first end and a second end opposite the first end. The main body portion may also include a bottom portion, a top portion opposite the bottom portion, a first passageway formed adjacent the second end, and a second passageway formed adjacent the first passageway. The top portion of the elongate tube may include a plurality of slots. The plurality of slots formed in the removable top member may include a spacing therebetween that is substantially similar to spacing between the plurality of slots formed in the top portion. The removable top member may be removeably connected to the top portion of the elongate tube so that, when removed, an interior portion of the elongate tube is accessible.

The removable top member may include a first locking tab formed on a bottom portion of the removable top member, adjacent to the first end of the main body. The removable top member may also include a second locking tab opposite the first locking tab that is removeably connected to the removable top member. The second locking tab may include a bottom locking tab member and a top locking tab member. The bottom locking tab member and the top locking member may be adapted to matingly engage one another.

The top locking tab member may include a bottom lock tab and a position lock member both extending downwardly from a bottom portion thereof. The bottom lock tab may be adapted to engage a first passageway of the removable top member. The position lock member may be adapted to engage the second passageway of the removable top member.

The bottom locking tab member may include an opening. The bottom locking tab member may further include a pair of lips so that the bottom lock tab engages the first passageway of the removable top member and the opening of the bottom locking tab member. The lips of the bottom locking tab member may engage a pair of wall portions of the bottom lock tab.

The second locking tab may be positionable between a locked position and an unlocked position. The locked position may securely attach the removable top member to the top portion of the elongate tube. The removable top member may be detachable from the top portion of the elongate tube when in the unlocked position.

The deck drain system may also include a space formed between the main body portion of the removable top member and the first locking tab. A space may also be formed between the main body portion of the removable top member and the second locking tab so that the first and second locking tabs engage the top portion of the elongate tube when the removable top member engages the opening formed in the top portion of the elongate tube.

A method aspect of the present invention is for utilizing a removable top member that matingly engages an opening formed in a deck drain. The method may include positioning the removable top member over the opening of a top portion of the deck drain and positioning the second locking tab in a locked position. The method may also include detaching the removable top member by moving the second locking tab to an unlocked position, which may, in turn, expose an interior portion of the deck drain.

DETAILED DESCRIPTION OF THE PREFERRED EMBODIMENT

Figure 1:
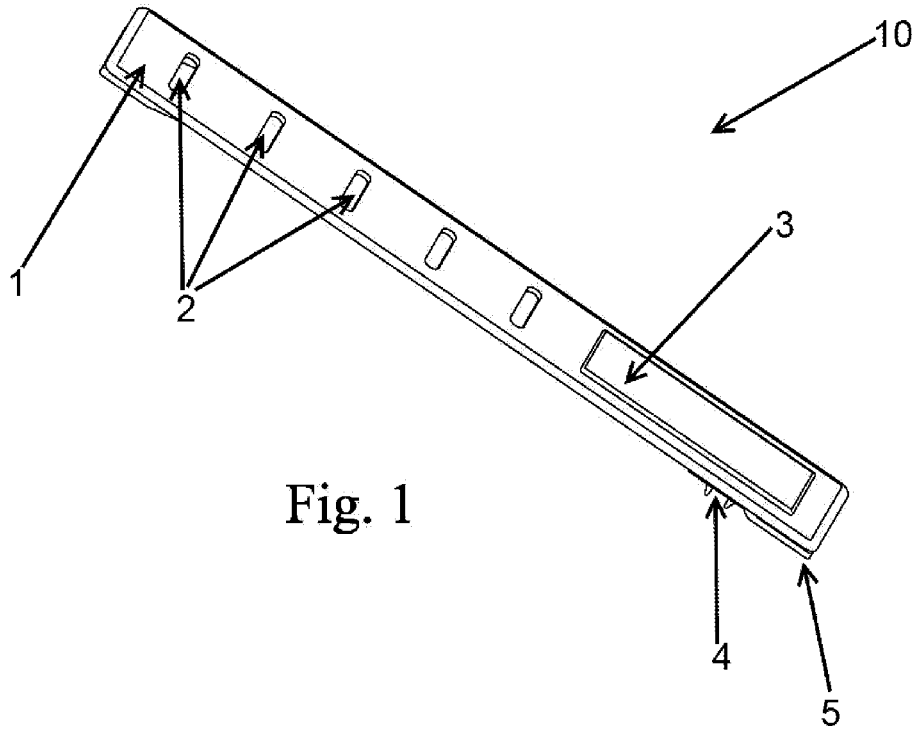
FIG. 1 is perspective view of a removable top member for use in connection with a deck drain system according to an embodiment of the present invention.
Figure 2:
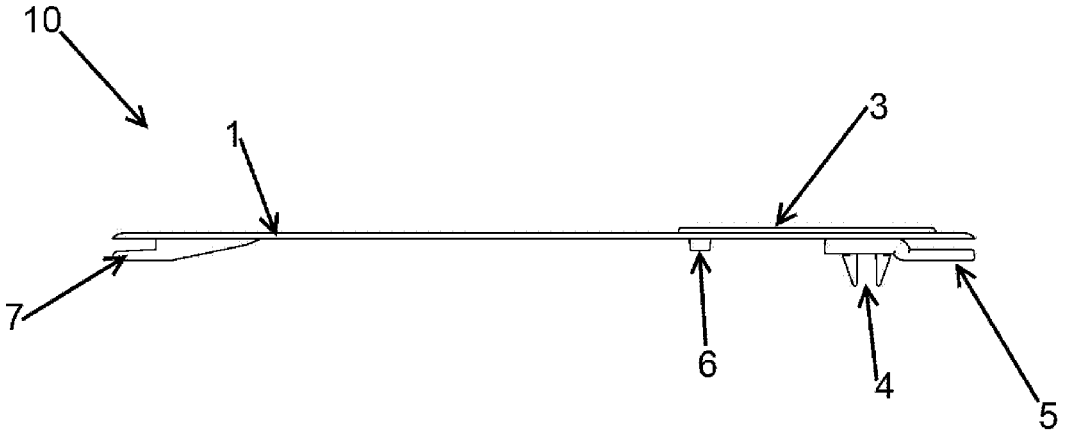
FIG. 2 is a side elevation view of the removable top member of FIG. 1.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Referring now to FIGS. 1-5, an embodiment of a deck drain system will now be discussed. The deck drain system may include a deck drain 40 and a removable top member 10. The deck drain 40 may also include an elongate tube 17 defined by a bottom portion 16 and a top portion 12. The bottom portion 16 may have an arcuate shape, and the top portion 12 may be substantially flat. Those skilled in the art will appreciate that use of the term "substantially flat" is meant to indicate a surface that is flat in shape, but that may not be completely flat. In other words, the top portion 12 may have some minimal curvature to it, and may not necessarily be completely flat. The term "substantially," as used herein, is to be given its common dictionary definition such as, for example, "of or pertaining to the essence of a thing; essential, material, or important." The top portion 12 may be defined as having a width that extends between the sides of the deck drain 40. For example, the top portion 12 may be connected to a pair of sidewalls 18 that extend downwardly therefrom. The sidewalls 18 may extend downwardly from the top portion 12 to the bottom portion 16 which, as disclosed above, preferably has an arcuate shape. The sidewalls 18 may be spaced apart from one another substantially the same width as the top portion 12 at the connecting point between the sidewalls and the top portion. As the sidewalls 18 extend downwardly, the width therebetween may be narrowed to a width that is smaller than the width of the top portion 12. The sidewalls 18 are then connected to the bottom portion 16 at the bottom of the sidewalls.

The sidewalls 18 are illustratively symmetrical as they extend from the top portion 12 to the bottom portion 16. Those skilled in the art will appreciate, however, that the sidewalls 18 do not necessarily need to extend symmetrical to one another to achieve the goals, features and objectives of the present invention. Instead, the sidewalls 18 can have any shape as they extend from the top portion 12 to the bottom portion 16. The sidewalls 18 illustratively include a slope portion to advantageously allow for water that flows into the deck drain to be channeled to the bottom portion 16. Those skilled in the art will also appreciate that the sidewalls 18 can be configured in any manner that will allow water to flow through the slots 13 (discussed in greater detail below) formed in the top portion 12 to the bottom portion 16.

Figure 4:
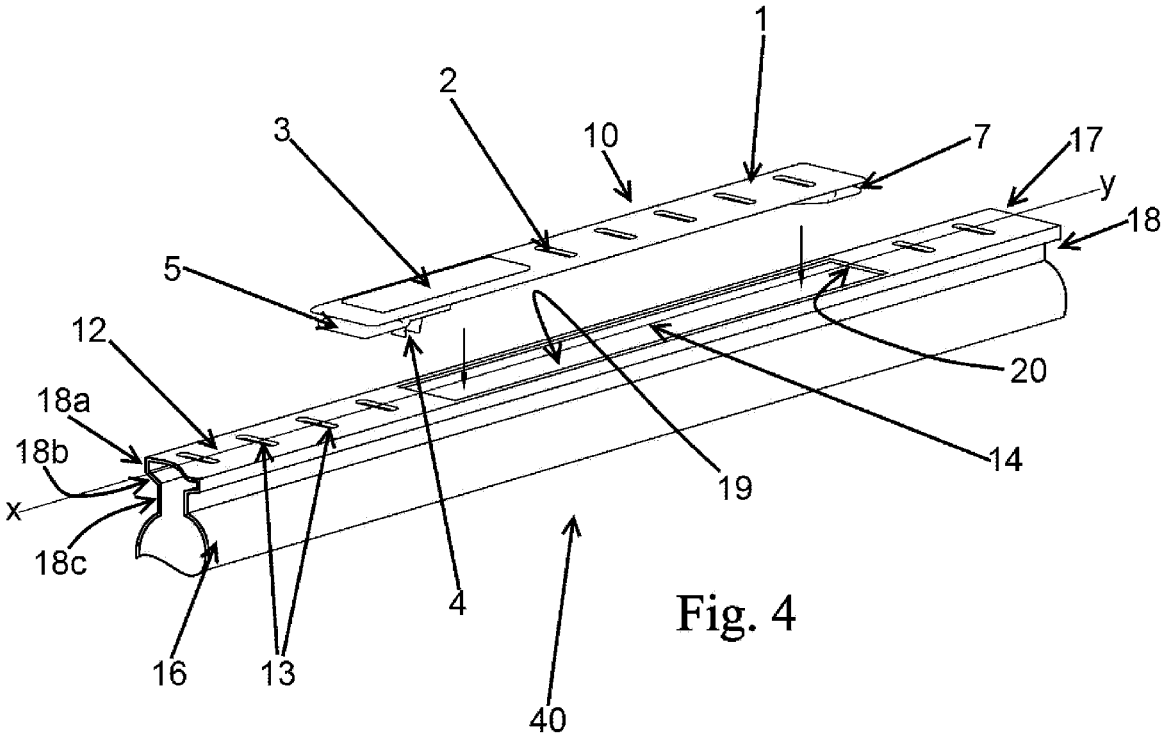
FIG. 4 is a partial perspective view of a deck drain system according to an embodiment of the present invention having portions cut away.
Figure 5:
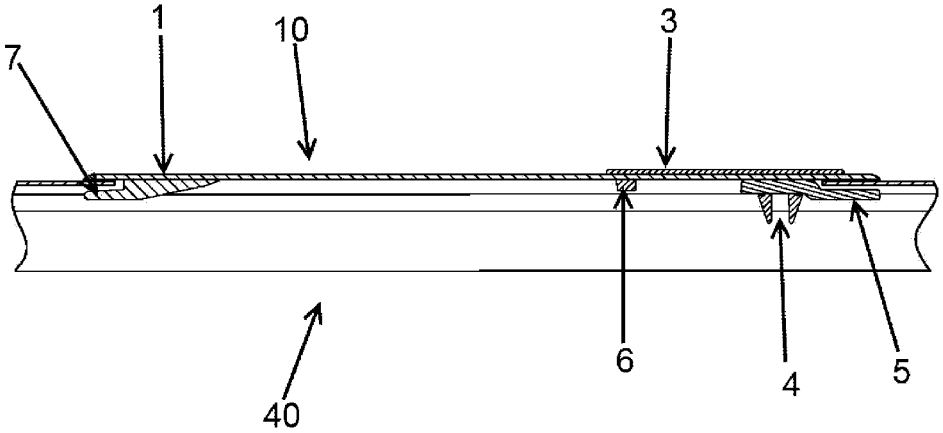
FIG. 5 is a cross sectional view along line X-Y of FIG. 4 of the deck drain system of FIG. 4.

As further illustrated in FIG. 4, each of the sidewalls 18 may have a first portion 18*a*, a second portion 18*b*, and a third portion 18*c*. The first portion 18*a* may extend downwardly in a configuration that is orthogonal, or substantially orthogonal, to the top portion 12. Those skilled in the art will appreciate that use of the term "substantially orthogonal" is meant to encompass a first portion 18*a* of the sidewall that may extend downwardly at 90° from the top portion 12, and also encompass a first portion of the sidewall that extends downwardly from a range of between about 75° and 105°. Those skilled in the art will still appreciate that although an example of a range between about 75° and 105° is provided, any range is contemplated while still achieving the goals, features and objectives of the present invention. The second portion 18*b* of the sidewall may slope in a general downward direction from the first portion 18*a* of the sidewall. Accordingly, the slope configuration of the second portion 18*b* of the sidewalk advantageously allows for water, or other fluid, that enters the deck drain through the slots 13 in the top portion 12 to be directed downwardly to the bottom portion 16. The third portion 18*c* of the sidewall extends downwardly from the second portion 18*b* of the sidewall to the bottom portion 16. Although illustrated as a generally vertically configured wall, those skilled in the art will appreciate that the third portion 18*c* of the sidewall may have a different configuration while still accomplishing the goals, features and objectives of the present invention.

The bottom portion 16 is illustrated in FIGS. 1-5 as having an arcuate shape, connected to the top portion 12 by the sidewalls 18. However, those skilled in the art will appreciate that the bottom portion 16 may be connected to the top portion 12 by sidewalls that are straight or substantially straight. The bottom portion 16 may have a "U-shape", a circular shape or a substantially square or rectangular shape. The bottom portion may have any shape that is known in the art while still accomplishing the goals, features and objectives of the present invention.

The deck drain 40 may also include an opening 14 formed in the top portion 12 defined by interior sidewalls 20. The top portion 12 of the elongate tube 17 may include a plurality of slots 13 formed therein. The top portion 12 may enable drainage of the deck area or the perimeter of the pool area by allowing fluid to flow into the deck drain 40 via the slots 13. In the present invention, the fluid that filters through the slots 13 collects in the bottom portion 16 which may be connected to a pool or secondary drainage area for the fluid to flow into. The slots 13 may be a plurality of spaced apart slots each having an elongate shape. The slots 13 illustrated in the deck drain 40 of the present invention are illustratively symmetrically spaced apart. Those skilled in the art will appreciate, however, that the slots 13 may have any spacing therebetween. Further, the slots 13 illustrated in the deck drain 40 may include a linear and ovular shape. This shape is exemplary in nature, and the slots 13 of the deck drain 40 according to embodiments of the present invention may have any shape that allows fluid to pass therethrough. For example, it is contemplated that the shape of the slots may be polygonal, circular, or any other shape that still accomplishes the goals, features and objectives of the present invention.

The top portion 12 may also include an opening 14. The removable top member 10 may be designed to fit into the opening 14. The opening 14 may reveal an interior portion 19 of the deck drain 40. The opening 14 formed in the top portion is illustrated with a rectangular shape. Those skilled in the art will appreciate that the shape of the opening 14 illustrated is only exemplary and that the shape of the opening 14 may be circular or any other shape known in the art without departing from the scope of the invention. Those skilled in the art will also appreciate that the shape of the removable top member 10 may be modified to match the shape of the opening 14 without departing from the scope of the invention. The opening 14 in the deck drain 40 may be advantageous as it enables a user to access the interior portion 19 of the deck drain so that the user may clean the deck drain 40 and/or remove any debris that may be clogging the deck drain system. A skilled artisan would appreciate that the deck drain 40 is illustrated with a single removable top member 10 for exemplary purposes. A skilled artisan would also appreciate that a deck drain 40 and its top portion 12 may be of such a length that a single opening 14 with a single removable top member 10 may not be able to provide sufficient access to the interior portion 19 of the deck drain. Therefore, it is contemplated in an embodiment of the present invention, that the deck drain 40 may include multiple openings 14 and multiple removable top members 10 to enable sufficient access to the interior portion 19 of the deck drain 40. The opening 14 may be located substantially in the center of the deck drain 40, i.e., the center as measured from the sidewalls 18 of the deck drain. However, the opening 14 may be located on any section of the deck drain 40 along the top portion 12 without departing from the scope of the invention. In an alternative embodiment, the opening 14 may be located at one end or both ends of the top portion 12.

Figure 3:
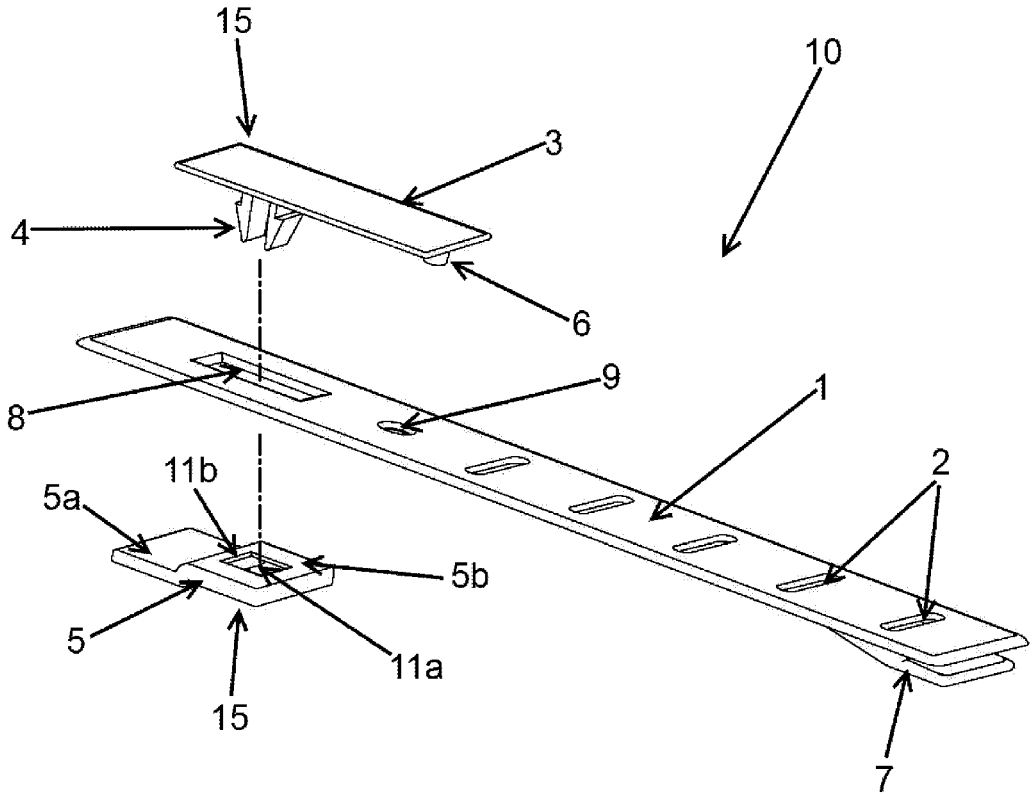
FIG. 3 is an exploded perspective view of the components of the removable top member of FIG. 1.

Still referring to FIGS. 1-5, the removable top member 10 may include a main body portion 1 having a plurality of slots 2. The spacing between the plurality of slots 2 may be substantially similar to the spacing between the plurality of slots 13 formed in the top portion 12. The removable top member 10 illustrated in FIG. 3 is substantially rectangular. The shape of the removable top member 10, as was described earlier, may be changed to match the shape and size of the opening 14 without departing from the scope of the invention. Skilled artisans would appreciate that the size of the removable member 10 may be adapted to match the size of the deck drain 40 so that it exposes an interior portion of an adequate size. The main body portion 1 may also include a first end and a second end opposite the first end, a bottom portion and, a top portion opposite the bottom portion. The top portion of the main body portion 1 may be defined as the upper surface of the main body portion 1 and the bottom portion of the main body portion 1 may be defined as the underside of the main body portion 1.

Referring now more specifically to FIG. 3, additional details of the removable top member 10 according to an embodiment of the present invention are now disclosed. The removable top member 10 may illustratively include a first passageway 8 formed adjacent the second end, and a second passageway 9 formed adjacent the first passageway 8. The first passageway 8 may have a substantially rectangular shape and the second passageway 9 may have a substantially circular shape. Skilled artisans will appreciate, however, that the shape of the first and second passageway 8, 9 may be altered or modified without departing from the scope of the invention. In a separate embodiment of the invention, the shape of the first and second passageways, 8, 9 respectively, may both be rectangular, or circular or any shape known in the art.

A first locking tab 7 may be formed on a bottom portion of the removable top member 10 adjacent the first end of the main body portion 1. More specifically, the first locking tab 7 is positioned on an end of the main body portion 1 that is preferably opposite the end having the first passageway 8 formed therein. A skilled artisan would appreciate that the first locking tab 7 and the main body portion 1 may be integrally formed as a monolithic unit. A second locking tab 15 may be formed at the second end of the main portion 1 opposite the first end. The first and second locking tabs, 7 and 15 respectively, each engage the interior sidewalls 20 (perhaps best illustrated in FIG. 4) when the removable top member 10 engages the opening 14 formed in the deck drain 40. The second locking tab 15 may include a bottom locking tab member 5 and a top locking tab member 3 which may be adapted to matingly engage one another as will be described further below. The first and second locking tabs, 7 and 15 respectively, are formed so that a space is formed between the removable top member 10 and each tab, 7 and 15. The space is slightly greater than the thickness of the interior sidewalls 20. The space between the removable top member 10 and the first locking tab 7 is substantially similar to the space between the removable top member 10 and the second locking tab 15. The space between the main body portion 1 of the removable top member 10 and the tabs 7 and 15 enables the removable top member 10 to seamlessly fit in the opening 14 of the deck drain 40, by enabling the main body portion 1 and the tabs 7 and 15 to fit over the interior sidewalls 20.

The top locking tab member 3 may include a bottom lock tab 4 and a position lock member 6 both extending downwardly from a bottom portion of the top locking tab member 3. The bottom lock tab 4 may be shaped as a pair of lips. Each lip may be shaped as a planar downward extension, and may include a ledge approximately half-way down the length of the extension. The ledge on each lip may face away from each other. One edge of the ledge may be connected to the extension and the other end of the ledge may be connected to the end of the extension to form a substantially pointed tip that is at the opposite end of the top locking member 3. The position lock member 6 may be shaped as a small cylindrical peg. Skilled artisans will appreciate that the shape of the bottom lock tab 4 may be modified without departing from the scope of the invention. Similarly, the shape of the position lock member 6 may be modified without departing from the scope of the invention.

The bottom lock tab 4 may be adapted to engage the first passageway 8 and the position lock member 6 may be adapted to engage the second passageway 9. The second locking tab 15 may be positionable between a locked position and an unlocked position. The locked position may securely attach the removable top member 10 to a deck drain 40. The removable top member 10 may be detachable from the deck drain 40 when the second locking tab 15 is in the unlocked position.

The bottom locking tab member 5 may be shaped as an elongated "Z". The bottom locking tab member 5 may include lower portion 5*a* and upper portion 5*b*. The upper portion 5*b* is slightly elevated with regards to the lower portion 5*a*. The upper portion 5*b* may include an opening 11*a* which may be defined as a rectangular space surrounded by walls 11*b*. Skilled artisans will appreciate that the shape of the opening 11*a* may be changed without departing from the scope of the invention. The shape of the opening 11*a* may be circular or any other shape known in the art while still accomplishing the aims and objectives of the invention. The upper portion 5*b* may connect to the removable top member 10 when the bottom lock tab 4 engages the first passageway 8 and the opening 11*a* of the bottom locking tab member 5.

When the upper portion 5*b* of the bottom locking tab member 5 is connected to the removable top member 10, a space is formed between the removable top member 10 and the lower portion 5*a*. This space is slightly greater that the thickness of the interior sidewall 20 of the opening 14. The space enables the second locking tab 15 to fit smoothly against the interior sidewall 20 so that the removable member 10 can fit into the opening 14 as described earlier.

The removable top member 10 may be secured to the deck drain 40 by placing the second locking tab 15 in the locked position. The locked position may be defined as the bottom lock tab 4 engaging the first passageway 8, passing through the opening 11*a* and gripping the underside of the wall portions 11*b*. In the locked position, the position lock member 6 may engage the second passageway 9. When the second lock tab member 15 is in a locked position, the removable member 10 remains securely in place in the opening 14 of the deck drain 40. The unlocked position may be defined as position lock member 6 being disengaged from the second passageway 9. Disengaging the position lock member 6 from the second passageway 9 may enable the second locking tab 15 to release its grip on the deck drain 40 by moving the top locking tab member 3 away from the interior sidewall 20 within the confines of the first passageway 8. Sliding the top locking tab member 3 away from the interior sidewall 20 may cause the bottom locking tab member 5 to also slide in a similar direction as the top and bottom locking tab members, 3 and 5 respectively, remain connected when the position lock tab member 6 is disengaged from the second passageway 9. Once the second locking tab 15 is no longer in a locked position, the removable top member 10 may be detached to reveal the interior portion 19 of the deck drain 40.

The deck drain 40 is designed for flush installation so that the surface of the surrounding area (for example a pool deck area) and the top portion 12 and the removable top member 10 form a substantially flat and continuous surface.

The deck drain 40 and the removable member 10 of the present invention may be made of any suitable material, preferably a polymeric material, such as Polyethylene, High Density Polyethylene (HDPE), or other plastic materials, and/or metals and/or metal alloys, such as steel, galvanized steel, or stainless steel, optionally coated with a corrosion resistant coating. Skilled artisans will appreciate that the list of materials from which the invention may be manufactured, are merely examples and that the deck drain system may be manufactured from any material known in the art that provides advantages similar to the materials listed.

The deck drain 40 may have any suitable length, such as, for example, from about one foot to about twenty feet, and any suitable height, such as, for example, from about eight inches to about twenty-four inches, and any suitable width, such as, for example, about four inches. Skilled artisans will appreciate that the dimensions of the deck drain 40 may be modified substantially without departing from the scope of the invention.

Figure 6:
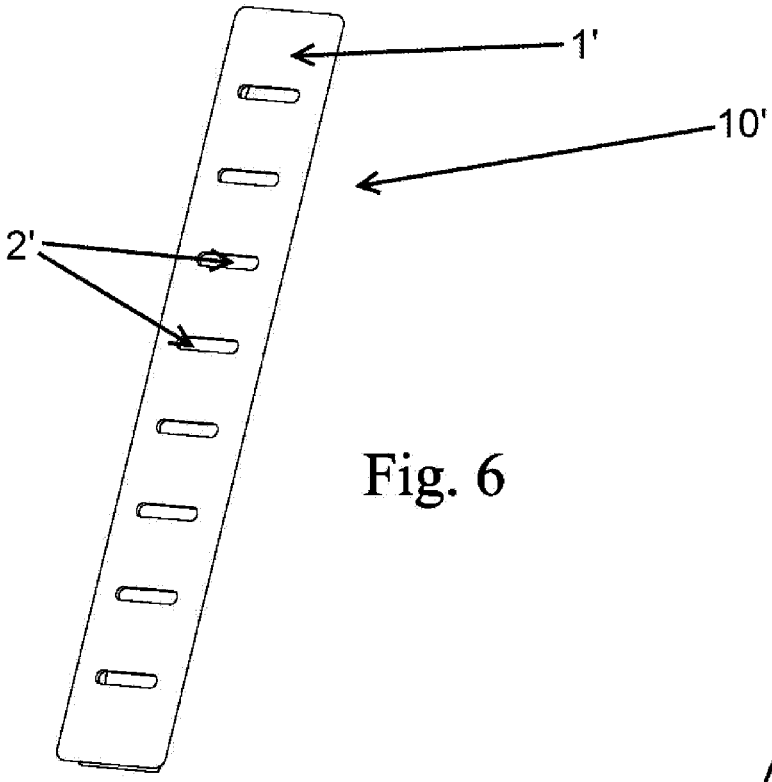
FIG. 6 is a top perspective view of another embodiment of a removable top member according to the present invention.
Figure 7:
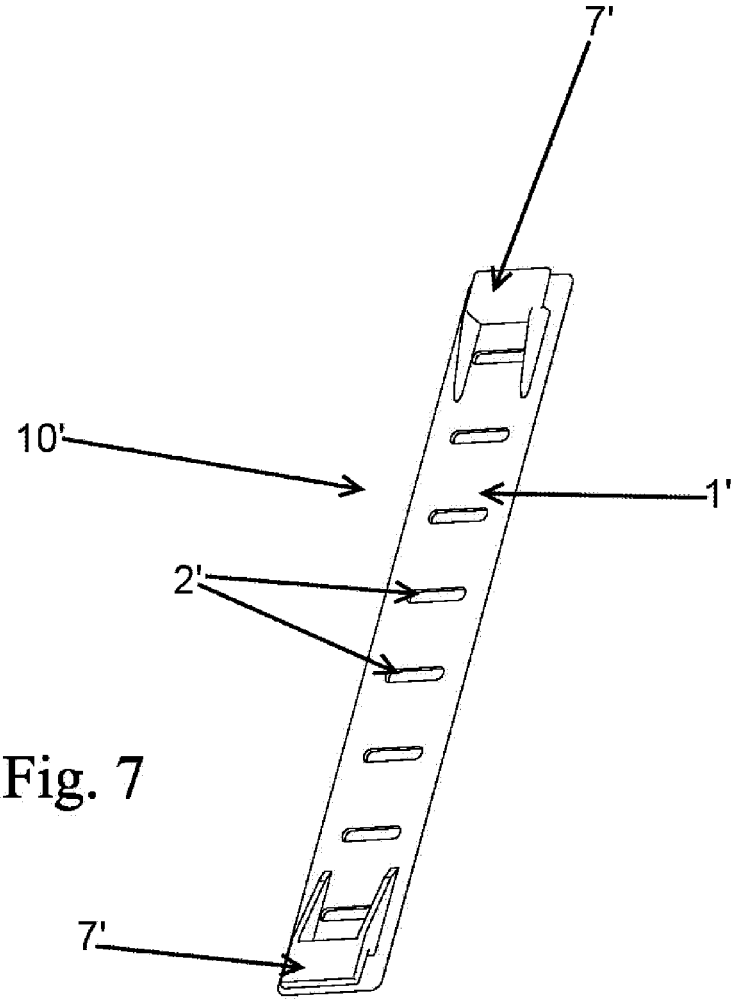
FIG. 7 is a bottom perspective view of the embodiment of the removable top member of FIG. 1.

An alternative embodiment of the present invention is illustrated in FIGS. 6-7. The elements of FIGS. 6-7 are labeled with a prime notation that relate to the elements of FIGS. 1-5. The elements that are not different from FIGS. 1-5 require no further discussion. The embodiment of the removable top member 10' illustrated in FIGS. 6-7 features a plurality of slots 2' and self locking tabs 7' on opposite ends of the bottom portion of the main body portion 1'. The removable top member 10' is designed without the lock mechanism of the second locking tab 15 illustrated in previous figures. The removable top member 10' is designed for simplified installation and removal as a user may detach the removable top member 10' without moving a locking tab to an unlocked position. In the alternative embodiment, the removable top member 10' and self locking tabs 7' may be a single integral unit.

A method aspect of the present invention will now be described. The method utilizes the deck drain 40 and the removable top member 10 illustrated in FIGS. 1-5. The method may include positioning the removable top member 10 over the opening 14 of a top portion of the deck drain 40. The method may also include positioning the second locking tab 15 in a locked position, where the locked position securely attaches the removable top member 10 to the top portion of the deck drain 40. The removable top member 10 may be detached by moving the second locking tab 15 to an unlocked position where detaching the removable top member 10 exposes an interior portion of the deck drain 40.

Some of the illustrative aspects of the present invention may be advantageous in solving the problems herein described and other problems not discussed which are discoverable by a skilled artisan. While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Many modifications and other embodiments of the invention will come to the mind of one skilled in the art having the benefit of the teachings presented in the foregoing descriptions and the associated drawings. The scope of the invention should be determined by the appended claims and their legal equivalents, and not by the examples given Therefore, it is understood that the invention is not to be limited to the specific embodiments disclosed.

What is claimed is:

1. A deck drain system comprising:

a deck drain having an elongate tube defined by a bottom portion and a top portion, the bottom portion having an arcuate shape, and the top portion being flat and having an opening formed therein;

wherein the top portion of the elongate tube has a plurality of slots formed therein; and a removable top member that matingly engages the opening formed in the top portion of the elongate tube;

the removable top member further comprising:

a main body portion having a plurality of slots formed therein, the main body portion having a first end, a second end opposite the first end, a bottom portion, a top portion opposite the bottom portion, a first passageway formed adjacent the second end, and a second passageway formed adjacent the first passageway;

wherein the plurality of slots formed in the removable top member have a spacing therebetween that is substantially similar to a spacing between the plurality of slots formed in the top portion;

wherein the removable top member is removeably connected to the top portion of the elongate tube so that, when removed, an interior portion of the elongate tube is accessible.

2. The deck drain system of claim 1 wherein the removable top member further comprises a first locking tab formed on a bottom portion of the removable top member thereof, adjacent to the first end of the main body.

3. The deck drain system of claim 2 wherein the removable top member comprises a second locking tab opposite the first locking tab that is removeably connected to the removable top member; wherein the second locking tab comprises a bottom locking tab member and a top locking tab member; and wherein the bottom locking tab member and the top locking tab member are adapted to matingly engage one another.

4. The deck drain system of claim 3 wherein the top locking tab member comprises a bottom lock tab and a position lock member both extending downwardly from a bottom portion thereof; wherein the bottom lock tab is adapted to engage a first passageway of the removable top member; and wherein the position lock member is adapted to engage the second passageway of the removable top member.

5. The deck drain system of claim 4 wherein the bottom locking tab member has an opening; wherein the bottom locking tab further comprises a pair of lips so that the bottom lock tab engages the first passageway of the removable top member and the opening of the bottom locking tab member; and wherein the lips of the bottom lock tab engage a pair of wall portions of the bottom locking tab member.

6. The deck drain system of claim 5 wherein the second locking tab is positionable between a locked position and an unlocked position; wherein the locked position securely attaches the removable top member to the top portion of the elongate tube; and wherein the removable top member is detachable from the top portion of the elongate tube when in the unlocked position.

7. The deck drain system of claim 3 wherein a space is formed between the main body portion of the removable top member and the first locking tab and between the main body portion of the removable top member and the second locking tab so that the first and second locking tabs engage the top portion of the elongate tube when the removable top member engages the opening formed in the top portion of the elongate tube.

8. A removable top member for use in connection with a deck drain system to matingly engage an opening formed in a portion of a deck drain, the removable top member comprising:

a main body portion having a plurality of slots formed therein, the main body portion having a first end, a second end opposite the first end, a bottom portion, a top portion opposite the bottom portion, a first passageway formed adjacent the second end, and a second passageway formed adjacent the first passageway;

a first locking tab formed on a bottom portion thereof, adjacent the first end of the main body;

a second locking tab opposite the first locking tab, the second locking tab comprising a bottom locking tab member and a top locking tab member, wherein the bottom locking tab member and the top locking tab member are adapted to matingly engage one another;

wherein the top locking tab member comprises a bottom lock tab and a position lock member both extending downwardly from a bottom portion thereof;

wherein the bottom lock tab is adapted to engage the first passageway;

wherein the position lock member is adapted to engage the second passageway;

wherein the second locking tab is positionable between a locked position and an unlocked position;

wherein the locked position securely attaches the removable top member to the deck drain; and wherein the removable top member is detachable from the deck drain when in the unlocked position.

9. The removable top member of claim 8 wherein a space is formed between the main body portion and the first locking tab and between the main body portion and the second locking tab so that the first and second locking tabs engage a top portion of the deck drain when the removable top member engages the opening formed in the deck drain.

10. The removable top member of claim 8 wherein the bottom locking tab member has an opening; wherein the bottom locking tab member further comprises a pair of lips so that the bottom lock tab engages the first passageway and the opening of the bottom locking tab member; and wherein the lips of the bottom locking tab member engage a pair of wall portions of the bottom lock tab.

11. A method of utilizing a removable top member that matingly engages an opening formed in a deck drain, wherein the removable top member comprises a main body portion having a plurality of slots formed therein, the main body portion having a first end, a second end opposite the first end, a bottom portion, a top portion opposite the bottom portion, a first passageway formed adjacent the second end, and a second passageway formed adjacent the first passageway, a first and second locking tab, the method comprising:

positioning the removable top member over the opening of a top portion of the deck drain;

positioning the second locking tab in a locked position within the first passageway, wherein the locked position securely attaches the removable top member to the top portion of the deck drain; and detaching the removable top member by moving the second locking tab to an unlocked position within the first passageway;

wherein detaching the removable top member exposes an interior portion of the deck drain.

12. The method of claim 11 wherein the first locking tab is formed on a bottom portion of the removable top member thereof, adjacent the first end of the main body.

13. The method of claim 12 wherein the second locking tab is formed opposite the first locking tab and is removeably connected to the main body portion of the removable top member; wherein the second locking tab comprises a bottom locking tab member and a top locking tab member; and wherein the bottom locking tab member and the top locking member are adapted to matingly engage one another.

14. The method of claim 13 wherein the top locking tab member comprises a bottom lock tab and a position lock member both extending downwardly from a bottom portion thereof; wherein the bottom lock tab is adapted to engage the first passageway; and wherein the position lock member is adapted to engage the second passageway.

15. The method of claim 14 wherein the bottom locking tab member has an opening; wherein the bottom locking tab member further comprises a pair of lips so that the bottom lock tab engages the first passageway and the opening of the bottom locking tab member; and wherein the lips of the bottom locking tab member engage a pair of wall portions of the bottom lock tab.

16. The method of claim 13 wherein a space is formed between the main body portion of the removable top member and the first locking tab and between the main body portion of the removable top member and the second locking tab so that the first and second locking tabs engage a top portion of the deck drain when the removable top member engages the opening formed in the top portion of the deck drain.

17. A deck drain system comprising:

a deck drain having an elongate tube defined by a bottom portion and a top portion, and the top portion having an opening formed therein;

wherein the top portion of the elongate tube has a plurality of slots formed therein; and a removable top member that matingly engages the opening formed in the top portion of the elongate tube;

the removable top member further comprising:

a main body portion having a plurality of slots formed therein, the main body portion having a first end, a second end opposite the first end, a first locking tab disposed on the first end of the main body portion, in a lengthwise direction of the main body portion, and a second locking tab disposed on the second end, in a lengthwise direction of the main body portion, the first locking tab and the second locking tab being configured so as to engage respective end faces of the of the top portion of the elongated tube, wherein the removable top member is removeably connected to the top portion of the elongate tube so that, when removed, an interior portion of the elongate tube is accessible.

* * * * *